US008182135B2

(12) United States Patent
Blackburn et al.

(10) Patent No.: US 8,182,135 B2
(45) Date of Patent: May 22, 2012

(54) MIXING MACHINE WITH BOWL SUPPORT

(75) Inventors: Neal H. Blackburn, Springfield, OH (US); Joseph C. Huang, Dayton, OH (US); Janice J. Schnipke, Springfield, OH (US)

(73) Assignee: Premark FEG L.L.C., Wilmington, DE (US)

( * ) Notice: Subject to any disclaimer, the term of this patent is extended or adjusted under 35 U.S.C. 154(b) by 620 days.

(21) Appl. No.: 12/357,628

(22) Filed: Jan. 22, 2009

(65) Prior Publication Data

US 2010/0180431 A1 Jul. 22, 2010

(51) Int. Cl.
*B01F 7/00* (2006.01)

(52) U.S. Cl. ..... 366/207

(58) Field of Classification Search ..... 366/97–98, 366/197, 206, 207, 348
See application file for complete search history.

(56) References Cited

U.S. PATENT DOCUMENTS

| | | | |
|---|---|---|---|
| 32,482 | A | 6/1861 | Lane |
| 140,527 | A | 7/1873 | Munson, Jr. |
| 227,239 | A | 5/1880 | Frentress |
| 320,255 | A | 6/1885 | Jackman |
| 613,888 | A | 11/1898 | Schmuck |
| 735,353 | A | 8/1903 | Eifert |
| 760,693 | A | 5/1904 | Lancaster et al. |
| 826,223 | A | 7/1906 | Broadwell |
| 879,590 | A | 2/1908 | Roth |
| 910,648 | A | 1/1909 | Davison |
| 1,143,484 | A | 6/1915 | Beach |
| 1,264,128 | A | 4/1918 | Rataiczak |
| 1,366,114 | A | 1/1921 | Boggs |
| 1,415,735 | A | 5/1922 | Trust et al. |
| 1,428,704 | A | 9/1922 | Petri |
| 1,468,615 | A | 9/1923 | Guttenstein et al. |
| 1,548,041 | A | 8/1925 | Johnston et al. |
| 1,548,919 | A | 8/1925 | Ward |
| 1,562,704 | A | 11/1925 | Kevan |
| 1,634,777 | A | 7/1927 | Girdler |
| 1,695,345 | A | 12/1928 | Read |
| 1,733,945 | A | 10/1929 | Dehuff |
| 1,743,271 | A | 1/1930 | Gould |

(Continued)

FOREIGN PATENT DOCUMENTS

| | | |
|---|---|---|
| DE | 1070563 | 12/1959 |

(Continued)

OTHER PUBLICATIONS

PCT, International Search Report and Written Opinion, International Application No. PCT/US2010/020865, 8 pages (Mar. 30, 2010).

(Continued)

*Primary Examiner* — Maria Veronica Ewald
(74) *Attorney, Agent, or Firm* — Thompson Hine LLP

(57) ABSTRACT

A mixing machine includes a base, a head including a rotatable output member for receiving a mixer tool and a support column extending vertically from the base to the head. A bowl receiving assembly is below the head. The bowl receiving assembly is configured to move vertically along the support column and defining a bowl receiving location. A bowl lock assembly includes a moveable bowl lock member carried by the bowl receiving assembly and having an unlock position and a lock position. The bowl lock assembly is configured such that placement of the bowl lock member in the unlock position or the lock position depends on a vertical position of the bowl receiving assembly.

12 Claims, 6 Drawing Sheets

U.S. PATENT DOCUMENTS

| | | | | |
|---|---|---|---|---|
| 1,761,237 | A | | 6/1930 | Schiff |
| 1,767,002 | A | | 6/1930 | Johnston et al. |
| 1,774,509 | A | | 9/1930 | Gould |
| 1,781,321 | A | | 11/1930 | Dehuff |
| 1,807,589 | A | | 6/1931 | Edmunds |
| 2,024,282 | A | | 12/1935 | Geiger |
| 2,122,628 | A | | 7/1938 | Tracy |
| 2,181,079 | A | | 11/1939 | Dehuff |
| 2,251,903 | A | | 8/1941 | Anstice et al. |
| 2,613,847 | A | | 10/1952 | Lacher |
| 3,073,493 | A | | 1/1963 | Pfaffenberger |
| 3,075,746 | A | | 1/1963 | Yablonski et al. |
| 3,255,913 | A | | 6/1966 | Helm |
| 3,533,603 | A | | 10/1970 | Kovacs |
| 3,633,719 | A | | 1/1972 | Lynch |
| 3,758,183 | A | | 9/1973 | Steinkamp et al. |
| 4,042,221 | A | | 8/1977 | Myers et al. |
| 4,135,828 | A | | 1/1979 | Cabak |
| 4,173,925 | A | | 11/1979 | Leon |
| 4,283,148 | A | | 8/1981 | Peterson |
| 4,402,466 | A | | 9/1983 | Schmidt |
| 4,765,746 | A | | 8/1988 | Suay Puig |
| 4,823,633 | A | | 4/1989 | Pike |
| 4,854,711 | A | | 8/1989 | Hagan |
| 4,937,916 | A | | 7/1990 | Redman |
| 4,946,285 | A | | 8/1990 | Vennemeyer |
| 5,048,709 | A | | 9/1991 | Alverson |
| 5,123,747 | A | | 6/1992 | Derksen |
| 5,157,983 | A | | 10/1992 | Sankovic |
| 5,306,083 | A | | 4/1994 | Caldwell et al. |
| 5,325,980 | A | | 7/1994 | Grimm et al. |
| 5,325,982 | A | | 7/1994 | Cobb, Jr. |
| 5,409,149 | A | | 4/1995 | Hough |
| 5,472,276 | A | | 12/1995 | Ratermann et al. |
| 5,494,350 | A | | 2/1996 | Childress |
| 5,547,278 | A | * | 8/1996 | Xie ..... 366/203 |
| 5,653,535 | A | | 8/1997 | Xie et al. |
| 5,690,427 | A | | 11/1997 | Jennings |
| 5,806,704 | A | | 9/1998 | Jamison |
| 5,860,738 | A | | 1/1999 | Brinkman |
| 5,934,802 | A | | 8/1999 | Xie |
| 5,961,193 | A | | 10/1999 | Hobbs |
| 6,092,647 | A | | 7/2000 | Yeh et al. |
| 6,494,610 | B1 | | 12/2002 | Brunswick |
| 6,595,680 | B2 | | 7/2003 | Sanpei et al. |
| 6,883,959 | B2 | | 4/2005 | Donthnier et al. |
| 2002/0093877 | A1 | | 7/2002 | Brunswick et al. |
| 2002/0181322 | A1 | | 12/2002 | Brunswick et al. |
| 2004/0120213 | A1 | | 6/2004 | Short et al. |
| 2004/0120215 | A1 | | 6/2004 | Huang et al. |
| 2004/0120216 | A1 | | 6/2004 | Donthnier et al. |
| 2004/0208082 | A1 | | 10/2004 | Huang et al. |
| 2005/0002272 | A1 | | 1/2005 | Brunswick et al. |
| 2005/0141340 | A1 | | 6/2005 | Donthnier et al. |

FOREIGN PATENT DOCUMENTS

| | | |
|---|---|---|
| DE | 1298510 | 7/1969 |
| EP | 1027920 | 8/2000 |
| EP | 1151669 | 7/2001 |
| FR | 1079799 | 5/1954 |
| FR | 2728485 | 6/1996 |
| FR | 2740064 | 4/1997 |
| FR | 2805177 | 8/2004 |
| GB | 120393 | 3/1919 |
| GB | 672619 | 5/1952 |
| JP | 11-347390 | 12/1999 |
| WO | WO 96/30114 | 10/1996 |

OTHER PUBLICATIONS

PCT, International Preliminary Report on Patentability, International Application No. PCT/US2010/020865 (Aug. 4, 2011).

* cited by examiner

MIXING MACHINE WITH BOWL SUPPORT

TECHNICAL FIELD

This application relates generally to mixing machines and, more particularly to a mixing machine and associated bowl support arrangement.

BACKGROUND

Mixers are used to mix and blend a variety of materials, such as food product. Typically, the materials are placed in a bowl and the bowl is located below a mixer head that includes a rotatable output member with a mixer tool. Various arrangements have been used to support the bowl beneath the mixer head. In some instances, the bowl is supported using a pair of bowl mount arms that extend about the bowl.

SUMMARY

In one aspect, a mixing machine includes a base, a head including a rotatable output member for receiving a mixer tool and a support column extending vertically from the base to the head. A bowl receiving assembly is below the head. The bowl receiving assembly is configured to move vertically along the support column and defining a bowl receiving location. A bowl lock assembly includes a moveable bowl lock member carried by the bowl receiving assembly and having an unlock position and a lock position. The bowl lock assembly is configured such that placement of the bowl lock member in the unlock position or the lock position depends on a vertical position of the bowl receiving assembly.

In another aspect, a method of mounting a bowl on a mixing machine for a mixing operation is provided. The method includes locating the bowl at a bowl receiving assembly positioned below a mixer head of the mixing machine. The bowl receiving assembly is raised vertically toward the mixer head thereby lifting the bowl. The raising step causes a bowl lock member of a bowl lock assembly to move from an unlock position into a lock position. In the lock position, the bowl lock member is located to engage a mount protrusion of the bowl. In the unlock position, the bowl lock member does not engage the mount protrusion of the bowl.

The details of one or more embodiments are set forth in the accompanying drawings and the description below. Other features, objects, and advantages will be apparent from the description and drawings, and from the claims.

DETAILED DESCRIPTION

Figure 1:
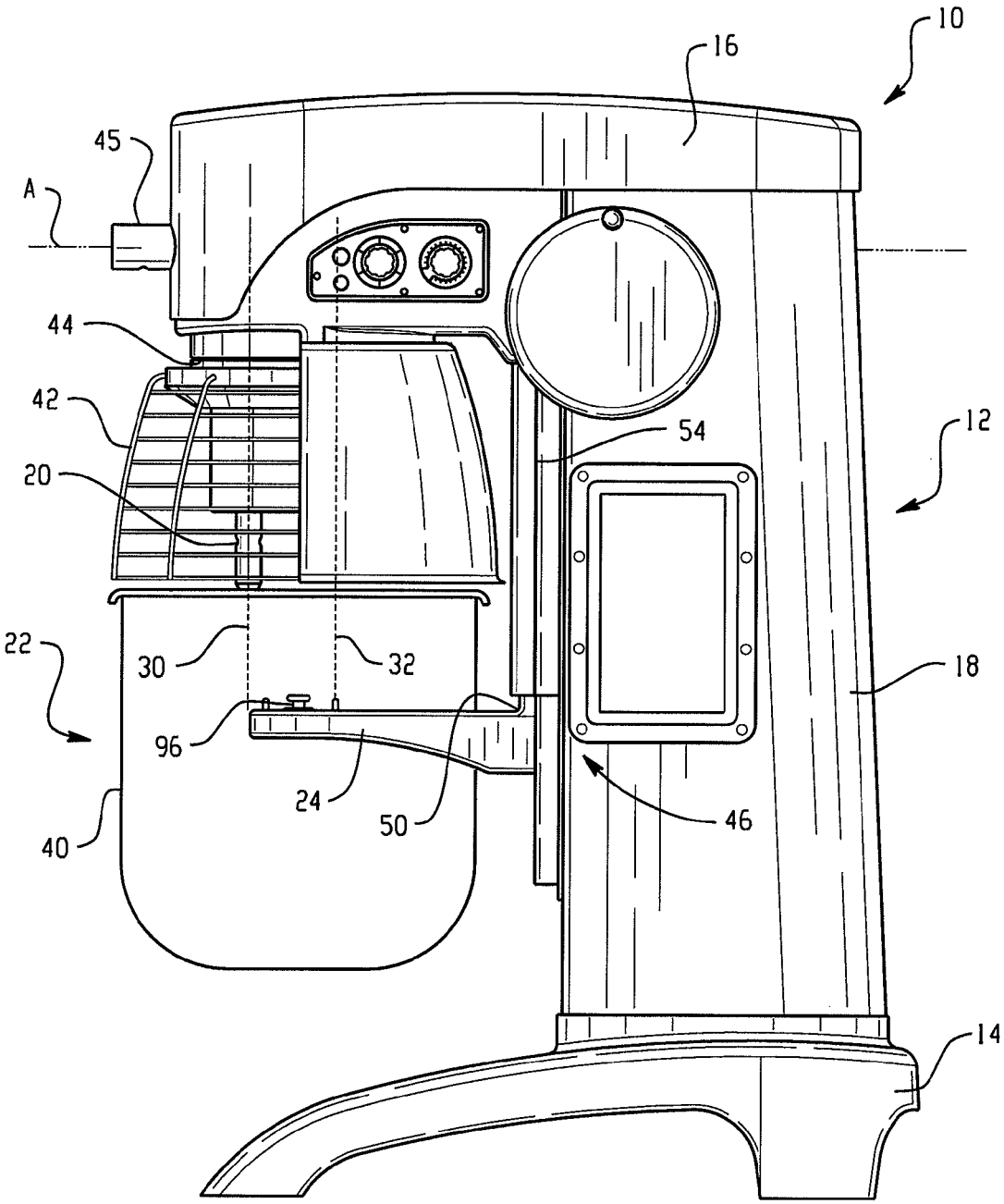
FIG. 1 is a side view of an embodiment of a mixing machine.

Referring to FIG. 1, a mixing machine 10 includes a mixer body 12 having a base portion 14, a head portion 16 and a support portion 18 (e.g., in the form of a column) connecting the head portion and the base portion in a vertically spaced-apart relationship. A front-to-back head portion axis A is shown. An output member 20 (e.g., a shaft for receiving a mixer tool such as a beater or whip) extends downward from the head portion 16 in a direction toward a bowl receiving location 22 formed between arms 24 of a bowl receiving assembly 46 that can be moved up and down relative to the head portion 16. A motor is located within the head portion 16 and may be mechanically linked to the output member 20, as by a gear system, for effecting rotation of the output member about a first axis 30 and rotation of the first axis 30 about a second axis 32 (e.g., a planetary movement or rotation).

In some embodiments, the mixing machine 10 includes a power take off 45 that extends outwardly from a front side of the head portion 16 and may take the form of a protruding hub or boss that is adapted for connection with mixer accessories such as meat grinders, slicers, etc. Internal of the power take off 45 may be a drive member that is rotated by the motor that also rotates the output member 20 via the gear system.

An exemplary mix position of a bowl 40 is shown by FIG. 1 along with an exemplary position of a bowl guard assembly 46. A bowl guard support 44 is located at an underside of the head portion 16 and supports at least part of the bowl guard assembly 46 in a manner that enables the bowl guard assembly to be moved between a bowl guarding position and a bowl access position.

The bowl 40 is mounted at the bowl receiving assembly 46 that is mounted for movement between a raised position toward the head portion 16 and a lowered position away from the head portion, the raised position being used during mixing operations and the lowered position being used for bowl installation and removal as well as for installation and removal of mixing tools on the rotatable output member 20. In this regard, curved arms 24 of the bowl receiving assembly 46 connect with a central support 50 and the support 50 rides upward and downward on a pair of spaced apart guide rails 54 on the front side of the column 18. A power lift mechanism (e.g., see screw 56 of FIGS. 4 and 5 which may be part of a screw drive system), such as a linear actuator, may be provided for effecting upward and downward movement of the bowl receiving assembly 46.

Figure 2:
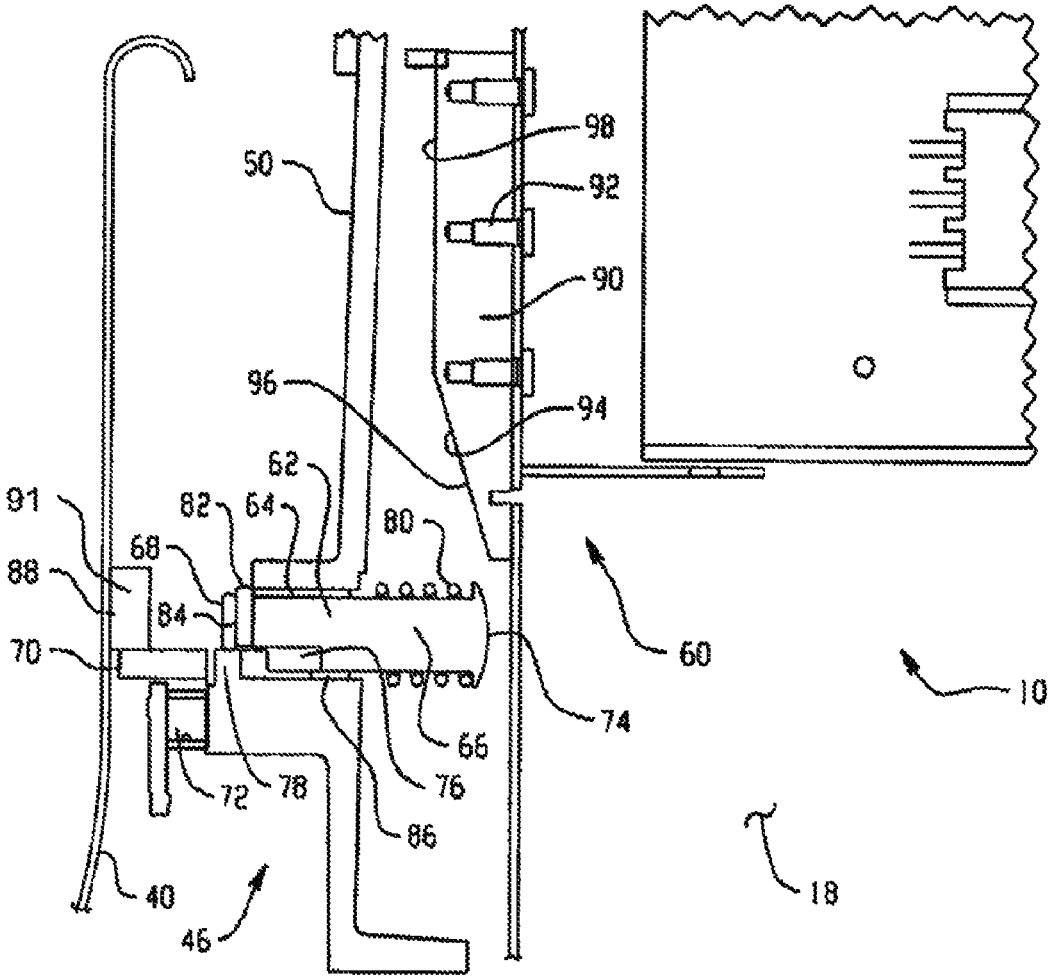
FIG. 2 is a diagrammatic view of an embodiment of a bowl lock assembly of the mixing machine of FIG. 1 with a bowl lock member in an unlock position.

Shown diagrammatically by FIG. 2, the mixing machine 10 includes a bowl lock assembly 60 that is used to further support and stabilize the bowl 40 at the bowl receiving assembly 46. The bowl lock assembly 60 is used to trap or otherwise engage a bowl mount protrusion 70 between a bowl lock member 62 and a support rest 72 of the bowl receiving assembly 46. The bowl lock member 62 is moveable between an unlock position (shown by FIG. 2) where the bowl lock member is positioned further away from the body of the bowl 40 and a lock position where the bowl lock member is positioned nearer to the body of the bowl. Movement of the bowl lock member 62 between the lock and unlock positions depends on the vertical position of the bowl receiving assembly 62 along the support portion 18.

The bowl lock assembly 60 includes the bowl lock member 62 that is carried by the bowl receiving assembly 46 and extends through an opening 64 in the central support 50 of the bowl receiving assembly. The bowl lock member 62 includes a projecting portion 66 that, in the illustrated embodiment, is pin-shaped including an end 68 that is located externally at a bowl-facing side of the opening 64 and a follower portion 74 that is in the shape of an enlarged head that extends outward from the projecting portion. A slot 76 is formed in the projecting portion 66 and extends to the end 68. The slot 76 is sized to receive a protrusion 78 extending upwardly at the support rest 72. The slot 76 has a length that allows the bowl lock member 62 to extend and retract between its lock and unlock positions and, along with the protrusion 78, prevents rotation of the bowl lock member within the opening 64.

In some embodiments, the bowl lock member 62 is biased, e.g., by spring 80 toward the unlock position. The spring 80 can be a coil spring that is wrapped about the projecting portion 66 and located between the follower portion 74 and the central support. A stop 82 (e.g., a pin, an o-ring, etc.) is provided at the end 68 of the bowl lock member 62. The stop 82 is sized to prevent retraction of the end 68 into the opening 64, for example, due to the biasing of the bowl lock member 62 toward the unlock position. In some embodiments, the stop 82 is located within a notch or opening 84 to inhibit sliding of the stop off of the end 68 of the bowl lock member 62. A bushing 86 may also be provided within the opening 64. The bushing 86 may be formed of a low friction material (e.g., Teflon) to facilitate sliding movement of the bowl lock member 62 within the opening 64.

A cam member 90 is mounted to the support portion 18. The position of the cam member is fixed (e.g., using fasteners 92) thereby providing a fixed cam surface 94 that includes a ramp portion 96 and a flat portion 98. The cam member 90 is located in the vertical travel path of the bowl lock member 62 to affect horizontal movement of the bowl lock member as the bowl receiving assembly 46 moves upward and downward, as will be described in greater detail below.

Referring still to FIG. 2, the bowl mount protrusion 70 is formed by a horizontal portion of an L-shaped bracket 88. The L-shaped bracket 88 includes a vertical portion 91 that is welded, fastened or otherwise attached to the bowl 40.

Figure 3:
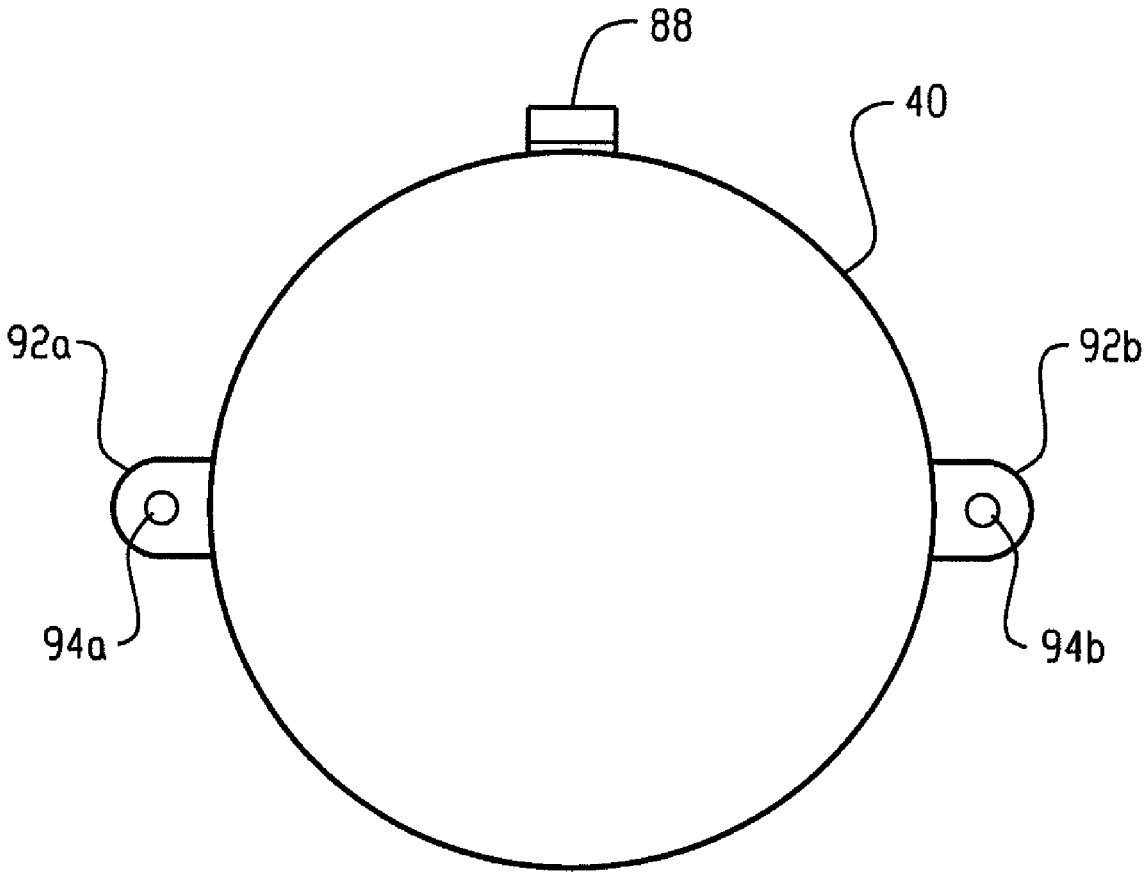
FIG. 3 is a diagrammatic, top view of an embodiment of a bowl for use with the mixing machine of FIG. 1.

Referring to FIG. 3, the L-shaped bracket 88 is located at a rear of the bowl 40 between side bowl mounts 92*a* and 92*b*. The side bowl mounts 92*a* and 92*b* include openings 94*a* and 94*b* that receive mount protrusions 96 on the arms 24 (FIG. 1).

Figure 4:
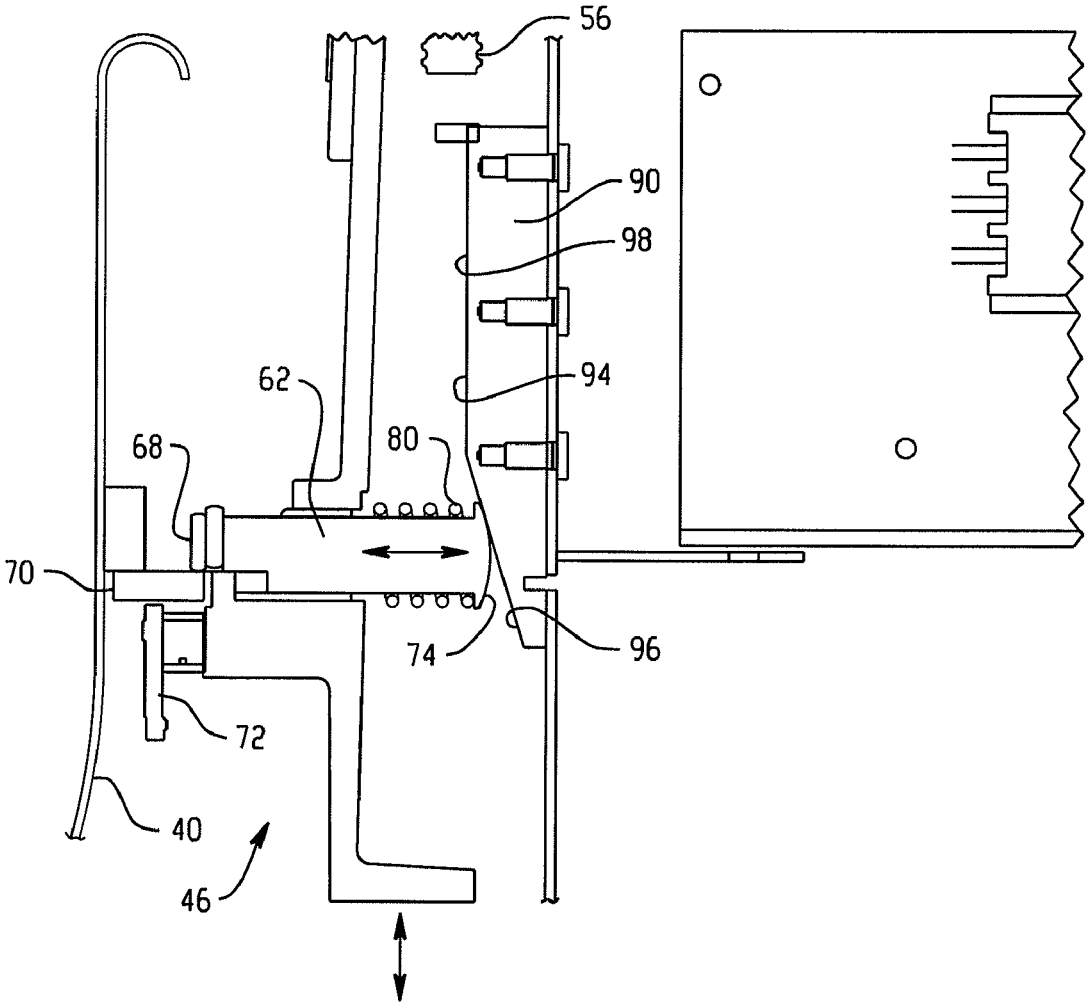
FIG. 4 is a diagrammatic view of the bowl lock assembly of the mixing machine of FIG. 2 with the bowl lock member in an intermediate position.
Figure 5:
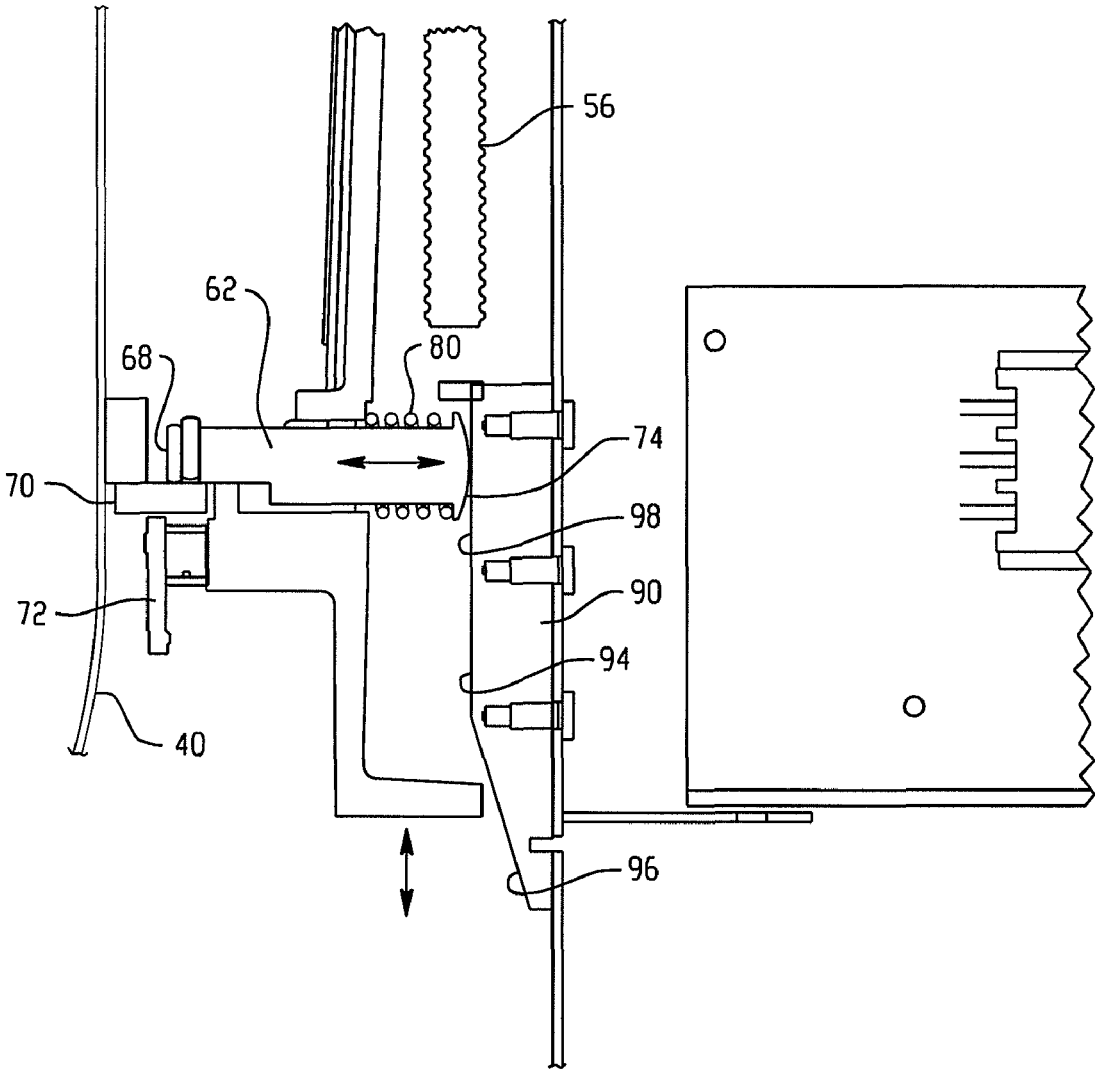
FIG. 5 is a diagrammatic view of the bowl lock assembly of the mixing machine of FIG. 2 with the bowl lock member in a lock position.

FIGS. 2, 4 and 5 show operation of the bowl lock assembly 60 as the bowl receiving assembly 46 moves the bowl 40 vertically. Referring first to FIG. 2, the bowl receiving assembly 46 is shown in its lowered position. In this position, the bowl lock member 62 is in its fully retracted, unlock position with the bowl 40 mounted at the bowl receiving assembly 46 and the bowl mount protrusion 70 resting on the support rest 72. As can be seen by FIG. 2, the cam member 90 is spaced vertically from the bowl lock member 62 such that the follower portion 74 is not engaged with the cam surface 94 with the bowl receiving assembly 46 in the illustrated lowered position. However, other embodiments are contemplated where the follower portion 74 is always engaged with the cam surface 94.

Referring to FIG. 4, as the bowl receiving assembly 46 is raised, the follower portion 74 of the bowl lock member 62 engages the ramp portion 96 of the cam surface 94. The ramp portion 96 is shaped to cause the bowl lock member 62 to extend toward the bowl 40 and overhang the bowl mount protrusion 70. The bowl lock member 62 continues to extend horizontally until the follower portion 74 reaches the flat portion 98 of the cam surface 94, shown by FIG. 5. Once the follower portion 74 reaches the flat portion 98 of the cam surface 94, the bowl lock member 62 remains in the lock position for the rest of the vertical travel of the bowl receiving assembly 46. Thus, the bowl lock member 62 moves during only part of the vertical travel of the bowl receiving assembly 46, reaching the lock position before the bowl receiving assembly reaches its fully raised position. Once in the lock position, the bowl lock member 62 and the bowl mount protrusion 70 prevent lifting of the bowl 40 and help stabilize the bowl during mixing operations.

Lowering the bowl receiving assembly 46 causes the bowl lock member 62 and its follower portion 74 to descend along the cam surface 94. The bowl lock member 62 remains engaged with the cam surface 94 as it moves over the ramp portion 96 (see FIG. 4) due to the bias provided by spring 80, causing the bowl lock member to retract toward the unlock position. Referring again to FIG. 2, the stop 82 prevents further retraction of the bowl lock member 62 once the stop engages surface 98 adjacent the opening 64.

Figure 6:
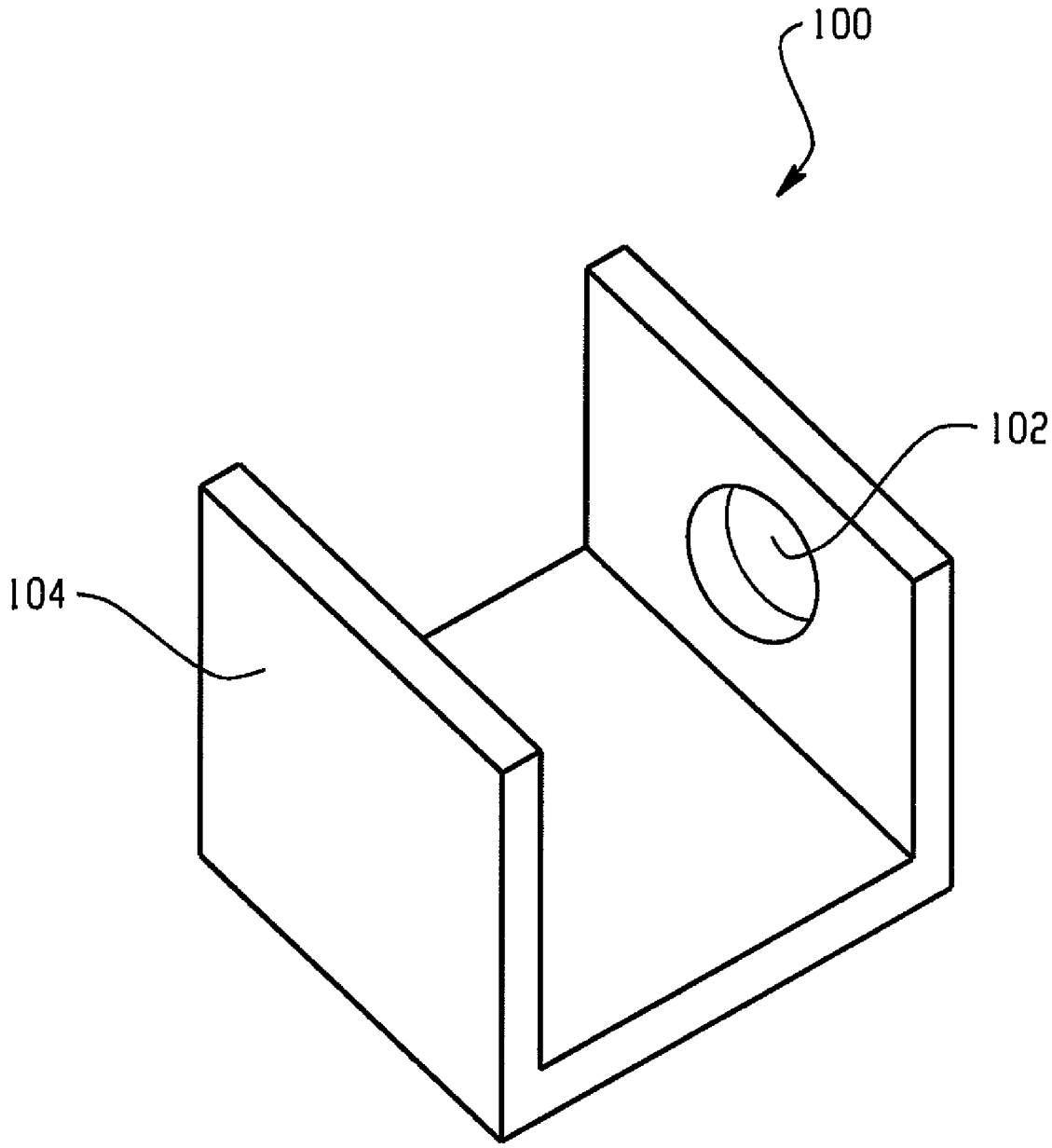
FIG. 6 is another embodiment of a mount protrusion for a bowl.

While an L-shaped mount protrusion is illustrated above, various other arrangements are contemplated. For example, referring to FIG. 6, a mount protrusion 100 is U-shaped and includes an opening 102 that is sized and arranged to receive end 68 of the bowl lock member 62 when the bowl lock member is placed in the lock position. Vertical portion 104 can be fastened, welded or otherwise attached to the rear of the bowl.

It is to be clearly understood that the above description is intended by way of illustration and example only and is not intended to be taken by way of limitation, and that changes and modifications are possible. Accordingly, other embodiments are contemplated and modifications and changes could be made without departing from the scope of this application.

What is claimed is:

1. A mixing machine, comprising:

a base;

a head including a rotatable output member for receiving a mixer tool;

a support column extending vertically from the base to the head;

a bowl receiving assembly below the head, the bowl receiving assembly configured to move vertically along the support column and defining a bowl receiving location; and a bowl lock assembly including a moveable bowl lock member carried by the bowl receiving assembly and having an unlock position and a lock position, wherein the bowl lock assembly is configured such that placement of the bowl lock member in the unlock position or the lock position depends on a vertical position of the bowl receiving assembly;

wherein the bowl lock assembly comprises a cam member including a cam profile, the bowl lock member comprising a follower that rides along the cam profile, the cam member and the follower both located internally of a central support of the bowl receiving assembly, the bowl lock member comprises a projecting pin member having one end internal of the central support and forming the follower and an opposite end that extends laterally through an opening of the central support toward the bowl receiving location.

2. The mixing machine of claim 1, wherein the bowl lock assembly is configured such that the bowl lock member is in the unlock position with the bowl receiving assembly in a lowered position and the bowl lock member is moved to the lock position when the bowl receiving assembly is moved to a raised position.

3. The mixing machine of claim 2, wherein the cam profile includes a ramp portion, the cam profile being stationary during vertical movement of the bowl receiving assembly.

4. The mixing machine of claim 3, wherein the bowl lock member moves vertically with the bowl receiving assembly.

5. The mixing machine of claim 2, wherein the bowl lock member is biased by a spring toward the unlock position.

6. The mixing machine of claim 1 further comprising a stop arranged and configured to prevent an external end of the projecting pin member from retracting into the opening of the central support of the bowl receiving assembly.

7. The mixing machine of claim 1, wherein the bowl receiving assembly comprises a first bowl support arm and a second bowl support arm, the first and second bowl support arms extending outwardly to respective ends located at opposite sides of the bowl receiving location.

8. The mixing machine of claim 7 further comprising a bowl including a first mount bracket that mounts the bowl to the first bowl support arm, a second mount bracket that mounts the bowl to the second bowl support arm and a mount protrusion between the first and second mount brackets, the bowl lock member extending outwardly to overhang the mount protrusion with the bowl lock member in the lock position.

9. The mixing machine of claim 8, wherein the mount protrusion rests on a support rest of the bowl receiving assembly, the mount protrusion being trapped between the support rest and the bowl lock member with the bowl lock member in the lock position.

10. A method of mounting a bowl on a mixing machine for a mixing operation, the method comprising:

locating the bowl at a bowl receiving assembly positioned below a mixer head of the mixing machine;

raising the bowl receiving assembly vertically toward the mixer head thereby lifting the bowl;

the raising step causing a bowl lock member of a bowl lock assembly to move from an unlock position into a lock position where, in the lock position, the bowl lock member is located to engage a mount protrusion of the bowl, where, in the unlock position, the bowl lock member does not engage the mount protrusion of the bowl;

wherein the bowl lock member comprises a pin member having one end internal of a portion of the bowl receiving assembly and an opposite end that extends laterally through an opening of the bowl receiving assembly toward the bowl, and a cam member internal of the portion of the bowl receiving assembly, the raising step causes the one end of the pin member to interact with the cam member to cause the pin member to slide laterally toward the mount protrusion of the bowl.

11. The method of claim 10 further comprising:

lowering the bowl receiving assembly thereby lowering the bowl; and the lowering step causing the bowl lock member to move from the lock position into the unlock position.

12. The method of claim 10 further comprising biasing the bowl lock member toward the unlock position.

* * * * *